US005803628A

United States Patent [19]

Donahue

[11] Patent Number: 5,803,628

[45] Date of Patent: Sep. 8, 1998

[54] PRINTING APPARATUS INCLUDING ENCODER PENDING

[75] Inventor: Frederick A. Donahue, Walworth, N.Y.

[73] Assignee: Xerox Corporation, Stamford, Conn.

[21] Appl. No.: 673,482

[22] Filed: Jul. 1, 1996

[51] Int. Cl.[6] ..... B41J 19/00

[52] U.S. Cl. ..... 400/279; 400/320

[58] Field of Search ..... 400/279, 320, 400/322, 323, 903, 157.2, 157.3, 166

[56] References Cited

U.S. PATENT DOCUMENTS

| | | | |
|---|---|---|---|
| 4,602,882 | 7/1986 | Akazawa | 400/903 |
| 4,701,685 | 10/1987 | Gruner | 400/903 |
| 4,706,008 | 11/1987 | Cronch et al. | 400/903 |
| 4,786,803 | 11/1988 | Majette et al. | 250/237 |
| 4,789,874 | 12/1988 | Majette et al. | 346/140 R |
| 4,844,635 | 7/1989 | Malkemes et al. | 400/279 |
| 5,187,479 | 2/1993 | Johnson, III et al. | 341/6 |
| 5,206,645 | 4/1993 | Urich | 341/11 |
| 5,254,919 | 10/1993 | Bridges et al. | 318/560 |
| 5,312,193 | 5/1994 | Kringe et al. | 400/279 |
| 5,426,457 | 6/1995 | Raskin | 347/37 |
| 5,433,541 | 7/1995 | Hieda et al. | 400/279 |
| 5,439,301 | 8/1995 | Nishizawa | 400/279 |

*Primary Examiner*—John S. Hilten
*Assistant Examiner*—Steven S. Kelley
*Attorney, Agent, or Firm*—Daniel J. Krieger

[57] ABSTRACT

A printing apparatus and method for printing on a recording medium at locations being determined by encoder pulses of an encoder signal generated by an encoder including an encoder pending circuit. The encoder pending circuit outputs an encoder pending signal indicating the generation of one of the encoder pulses during a current printing operation. A controller coupled to the encoder pending circuit, receives the encoder pending signal and generates an enable signal after the completion of the current printing operation. The method of printing includes receiving one of the encoder pulses; determining whether the received one of the encoder pulse is generated during a current printing operation and completing the current printing operation before responding to the received one of the encoder pulses.

20 Claims, 4 Drawing Sheets

PRINTING APPARATUS INCLUDING ENCODER PENDING

FIELD OF THE INVENTION

This invention relates generally to an apparatus and method for improving motion control of a moving component and more particularly to a printing apparatus operating at an optimum print speed without sacrificing print quality.

BACKGROUND OF THE INVENTION

Liquid ink printers of the type frequently referred to as continuous stream or as drop-on-demand, such as piezoelectric, acoustic, phase change wax-based or thermal, have at least one printhead from which droplets of ink are directed towards a recording medium. Within the printhead, the ink is contained in a plurality of channels. Power pulses cause the droplets of ink to be expelled as required from orifices or nozzles at the end of the channels.

In a thermal ink-jet printer, the energy pulses are usually produced by resistors each located in each one of the respective channels and individually addressable by current pulses to heat and vaporize ink in the channels. A thermal energy generator, usually a resistor or a heater, is located in each of the channels, a predetermined distance from the nozzles. The resistors are individually addressed with a current pulse to momentarily vaporize the ink thereby forming a bubble which expels an ink droplet. As the bubble grows, the ink which bulges from the nozzles, is contained by the surface tension of the ink as a meniscus. As the bubble begins to collapse, the ink remaining in the channel between the nozzle and the bubble move towards the collapsing bubble causing a volumetric contraction of the ink at the nozzle resulting in the separation of the bulging ink as a droplet. The acceleration of the ink out of the nozzle while the bubble is growing provides the momentum and velocity of the droplet in a substantially straight line direction towards the recording medium. The droplet of ink lands on the recording medium and forms an ink spot. Because the droplet of ink is emitted only when the resistor is actuated, this type of ink jet printing is known as drop-on-demand printing. The channel is then refilled with ink by capillary action, which, in turn, draws ink from a supply container. Operation of a thermal ink-jet printer is described in, for example, U.S. Pat. No. 4,849,774.

One particular form of ink jet printer is described in U.S. Pat. No. 4,638,337. The described printer is of the carriage type and has a plurality of printheads each having its own supply cartridge mounted on a reciprocating carriage. The nozzles in each printhead are aligned perpendicularly to the line of movement of the carriage and a swath of information is printed on the stationary recording medium as the carriage is moved in one direction. The recording medium is then stepped perpendicularly to the line of carriage movement by a distance equal to the width of the printed swath. The carriage is then moved in the reverse direction to print another swath of information. Full width or page width linear arrays in which the sheet is moved past a linear array of nozzles extending across the full width of the sheet, are also known.

In a typical ink-jet printing machine, the carriage must transport the printhead assembly across the page for printing and must also move the carriage to predetermined locations for capping, priming, and other maintenance functions for the printhead and the printhead nozzles thereof. In each of these instances, the carriage is moved across the recording medium in a controlled fashion or is parked at the predetermined locations along the carriage rails. A carriage motor and electronic controller are provided to precisely position the carriage at these locations. Since a motor is typically used, the rotary motion of the motor, is converted to the linear motion of the carriage by among others, a toothed belt/pulley, a cable/capstan or a lead screw. In addition to these devices, which move the carriage in a linear fashion, the linear motion is controlled and/or kept track of by an encoder.

Linear and rotary encoders are used for positioning and timing of movable members. In linear encoders, a linear strip of material includes a plurality of markings called fiducial markings, which are typically illuminated by a source of light and detected by an optical sensor to determine positioning and timing. The optical sensor detects the fiducial markings and generates a series of electrical pulses which are transmitted to a control system for controlling the motion of a movable member, such as a printhead carriage. The linear strip of fiducial markings is mounted on the printer parallel to the anticipated path of the carriage as it traverses across the recording medium. The light source and sensor are mounted on the carriage so that as the carriage reciprocates back and forth across the recording medium the combination light source/sensor can illuminate and detect the fiducial markings on the encoder strip for controlling the motion of the printhead carriage.

Rotary encoders use a disk coupled to a rotating member in which the disk includes a plurality of spaced marks. The marks are arranged on the disk so that as the marks rotate with the rotating member an illumination source/sensor senses the marks for determining the position, velocity and acceleration the rotating member. The illuminating source and the sensor can be disposed on opposite sides of the rotating disk to sense the passage of marks if the disk is transparent to light. In this way, a pulse is generated for each increment between adjacent marks of the disk.

In both the linear strip and disk encoders, a series of encoder pulses is generated indicating the position of the moving member along a predetermined path. In an ink jet printer, for instance, the position of a scanning printhead along a scan axis is monitored according to the generated encoder pulses. Ink is deposited at the appropriate locations to create an image. The encoder pulse are received by a controller or state machine of the printer which transmits a signal in response thereto for initiating printing by the printhead of the correct image information at the correct location.

Various encoders and methods for controlling the positioning of movable members are illustrated and described in the following disclosures which may be relevant to certain aspects of the present invention.

U.S. Pat. No. 5,187,479 to Johnson, III, et al., describes a circuit for compensating the backlash of a shaft on an incremental encoder having quadrature and index pulse output lines. The circuit conditions electrical signals from an incremental encoder when the encoder's shaft is induced to rotate in a direction counter to the normal operation of the equipment being controlled.

U.S. Pat. No. 5,206,645 to Urich describes an apparatus for generating a pulse train in which the apparatus includes a member having a plurality of spaced marks disposed thereon with at least one of the spaced marks being a reference mark. The pulse train has a periodicity defined by the same edge of two successive pulses and the plurality of spaced marks are configured so that the periodicity of the pulse train remains constant.

U.S. Pat. No. 5,254,919 to Bridges et al. describes an encoder system having an encoder element driven by a motor with a series of segments arranged along a path. Adjacent segments having different properties meet at an edge or transition. Two adjacent segments of different properties comprise a cycle and the encoder element having a number of cycles equally spaced along the path define a relatively course pitch relationship.

U.S. Pat. No. 4,786,803 to Majette et al. describes a single channel encoder comprising a transparent scale in which scale divisions are defined by transverse opaque lines. An emitter holder and a detector holder snap together clamping an aperture plate therebetween.

U.S. Pat. No. 4,789,874 to Majette et al. describes a single channel encoder system providing control of position, velocity and direction of movement of a member in an axis of freedom employing a scale having scale divisions and bands or zones defining limits of constant velocity control, acceleration and deceleration zone limits, and a rest or parking position. A single channel encoder produces time varying output signals in response to sensing of scale divisions along the scale. The time varying output signals are employed as scale division count signals for position determination and as scale division count signals per unit of time for velocity feedback.

U.S. Pat. No. 5,426,457 to Raskin describes direction independent encoder reading, position leading and delay, and uncertainty to improve bi-directional printing of a printer. Inversion of an encoder signal during pen carriage operation in just one of two printing directions causes development of the position signal pulse at each encoder bar to be generated from the same edge of each bar. The pulse circuit is always triggered from the same apparent wave form feature.

SUMMARY OF THE INVENTION

In accordance with one aspect of the present invention, there is provided a printing apparatus printing on a recording medium at locations being determined by encoder pulses of an encoder signal generated by an encoder. The printing apparatus includes an encoder pending circuit, outputting an encoder pending signal indicating the generation of one of the encoder pulses during a current printing operation, and a controller, coupled to the encoder pending circuit, receiving the encoder pending signal and generating an enable signal after the completion of the current printing operation.

Pursuant to another aspect of the invention, there is provided a method of controlling a printing element of a printing apparatus printing on a recording medium at locations being determined by encoder pulses of an encoder signal generated by an encoder, comprising the steps of receiving one of the encoder pulses, determining whether the received encoder pulse is generated during a current printing operation of the printing element: and completing the current printing operation before responding to the received one of the encoder pulses.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
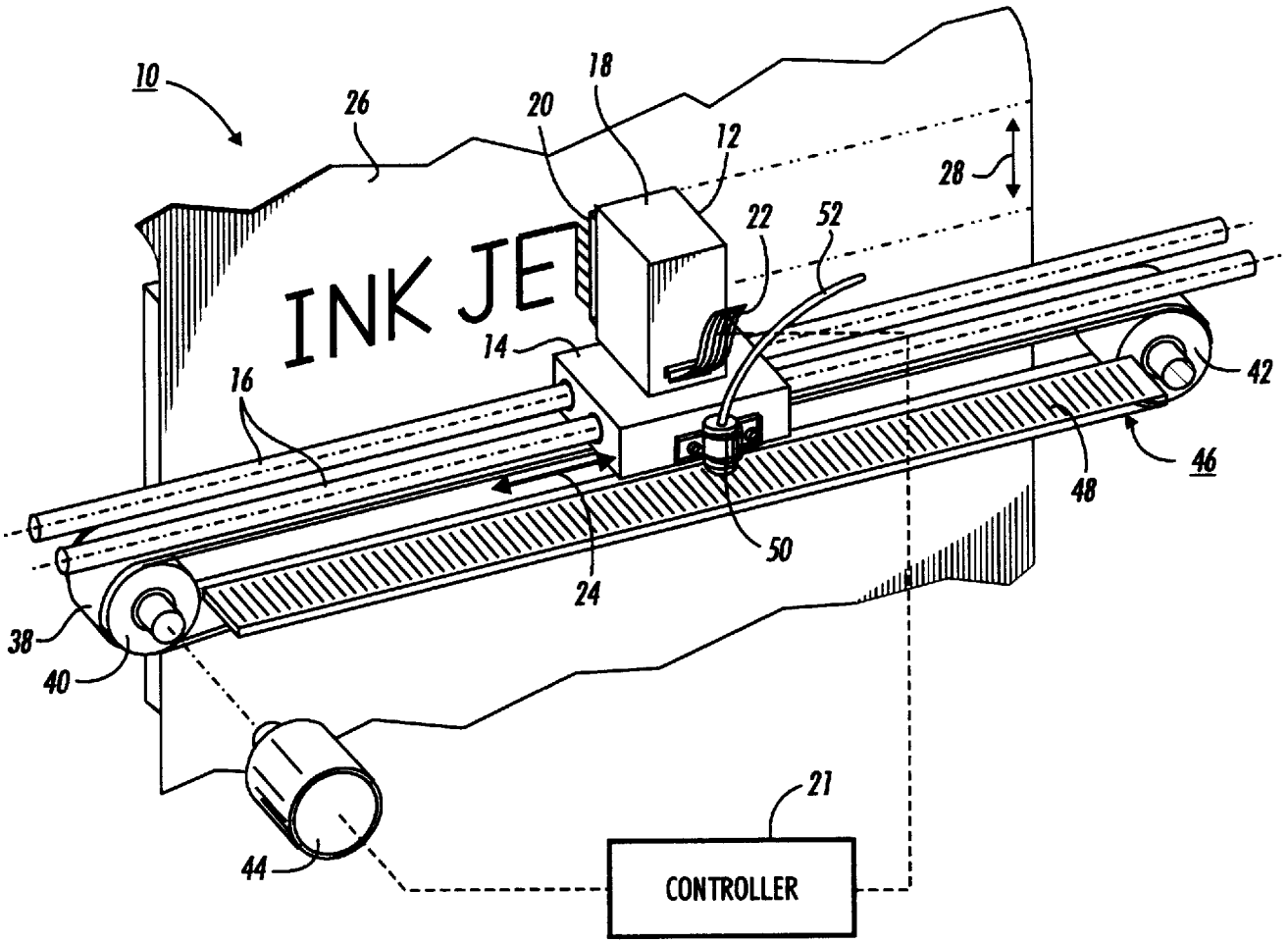
FIG. 1 is a partial schematic perspective view of an ink jet printer incorporating the present invention.

FIG. 1 illustrates a partial schematic perspective view of an ink jet printer 10 having an ink jet printhead cartridge 12 mounted on a carriage 14 supported by carriage rails 16. The printhead cartridge 12 includes a housing 18 containing ink for supply to a thermal ink jet printhead 20 which selectively expels droplets of ink under control of electrical signals received from a controller or state machine 21 of the printer 10 through an electrical cable 22. The printhead 20 contains a plurality of ink conduits or channels (not shown) which carry ink from the housing 18 to respective ink ejectors, which eject ink through orifices or nozzles (also not shown). When printing, the carriage 14 reciprocates or scans back and forth along the carriage rails 16 in the directions of the arrow 24. As the printhead cartridge 12 reciprocates back and forth across a recording medium 26, such as a sheet of paper or transparency, droplets of ink are expelled from selected ones of the printhead nozzles towards the sheet of paper 26. The ink ejecting orifices or nozzles are typically arranged in a linear array substantially perpendicular to the scanning direction 24. During each pass of the carriage 14, the recording medium 26 is held in a stationary position. At the end of each pass, however, the recording medium is stepped by a stepping mechanism under control of the printer controller 21 in the direction of an arrow 28. For a more detailed explanation of the printhead and printing thereby, refer to U.S. Pat. No. 4,571,599 and U.S. Pat. No. Reissue 32,572, the relevant portions of which are incorporated herein by reference.

It is well known and commonplace to program and execute imaging, printing, document, and/or paper handling control functions and logic with software instructions, such as included in the controller 21, for conventional or general purpose microprocessors. This is taught by various prior patents and commercial products. Such programming or software may of course vary depending on the particular functions, software type, and microprocessor or other computer system utilized, but will be available to, or readily programmable without undue experimentation from, functional descriptions, such as those provided herein, or prior knowledge of functions which are conventional, together with general knowledge in the software and computer arts. That can include object oriented software development environments, such as C++. Alteratively, the disclosed system or method may be implemented partially or fully in hardware, using standard logic circuits or a single chip using VLSI designs.

The carriage 14 is moved back and forth in the scanning directions 24 by a belt 38 attached thereto. The belt 38 is driven by a first rotatable pulley 40 and a second rotatable pulley 42. The first rotatable pulley 40 is, in turn, driven by a reversible motor 44 under control of the controller 21 of the ink jet printer. In addition to the toothed belt/pulley system for causing the carriage to move, it is also possible to control the motion of the carriage by using a cable/capstan, lead screw or other mechanisms as known by those skilled in the art.

To control the movement and/or position of the carriage 14 along the carriage rails 16, the printer includes an encoder having an encoder strip 46 which includes a series of fiducial marks in a pattern 48. The pattern 48 is sensed by a sensor 50, such as a photodiode/light source attached to the printhead carriage 14. The sensor 50 includes a cable 52 which transmits electrical signals representing the sensed fiducial marks of the pattern 48 to the printer controller 21.

Figure 2:
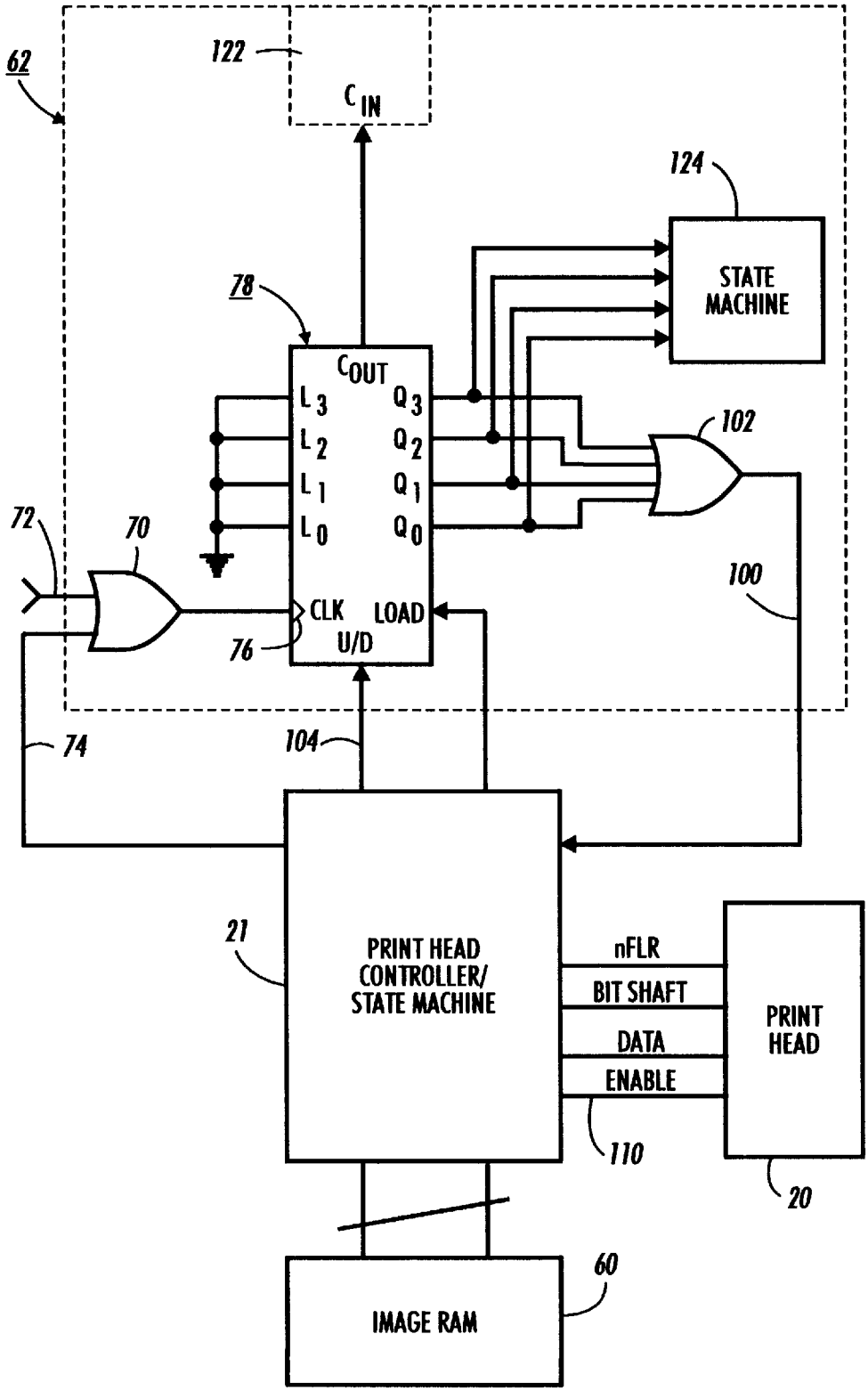
FIG. 2 is a block diagram of an electronic circuit for an ink jet printer incorporating an encoder pending circuit.

The printhead 20, for instance, includes 128 jetting nozzles (at 300 dots per inch) arranged in a linear monolithic package. As the printhead element 20 scans across the recording medium 26 in the scanning direction, jetting or deposition of ink upon the recording medium 26 in response to video data occurs. The received video data is generated by an image input terminal, such as a personal computer, and is typically supplied in a serial fashion to the printhead 20 over a data line, such as is described in U.S. Pat. No. 5,300,968 to Hawkins, herein incorporated by reference. The data, which is oftentimes stored in an image random access memory (RAM) 60, as illustrated in FIG. 2, is then directed to the appropriate transducer elements (not shown) of the thermal ink jet printhead such that the input image is accurately reproduced on the recording medium 26 by the printhead controller/state machine 21.

Control of the thermal ink jet printhead transducers or heaters of the printhead 20 is accomplished by the controller 21 or a digital logic state machine as is known in the art. Although it is possible to implement the control structure for the printhead 20 in software which is then executed on a controller 21 including microcontrollers or microprocessors, it is common that a finite state machine is used to control the ejection of ink by the printhead 20. Under control of the controller/state machine 21, the printhead 20 ejects ink simultaneously within banks of ejectors (which are subsets of the entire number of nozzles in a linear array) and sequentially from bank to bank. The banks of nozzles eject ink sequentially such that the entire 128 nozzle printhead ejects ink over a predetermined period of time according to the amount of time necessary to print a single bank and then to shift from one bank to the next such that the entire array of nozzles ejects ink. In one known example, printhead nozzles eject ink simultaneously four at a time within a bank. A 128 nozzle printhead therefore requires thirty-two of these four nozzle firings. If each firing time for a single bank requires 3 microseconds, 96 microseconds are required at a minimum to ripple through a single stroke of a printhead.

It is desirable to operate printheads at a maximum print speed to allow the highest possible print throughput. However, a printhead carriage scanning mechanism, such as the rotatable pulleys 40 and 42 and the reversible motor 44, typically move at a rate 10–15% slower in operation than maximum. This rate provides a margin of error for motion speed variations or encoder circuitry errors that can cause an encoder signal to be generated before the completion of previous stroke of ink being deposited on the recording medium. That is, in our example, a period of less than 96 microseconds.

In known systems, when an encoder pulse is generated while a stroke of information is still being printed by the printhead 20, the transfer of data from the image RAM 60 or an image buffer is either lost, or an error in vertical synchronization occurs, also known as buffer roll, between the information being read from the image RAM 60 and the selection of a correct nozzle in the printhead. For instance, when buffer roll occurs, the information contained in the image RAM is sent to an incorrect nozzle such that information which should be printed with a first nozzle of the linear array of nozzles is instead printed, for instance, at a middle nozzle. Such defects are unacceptable when printing documents.

The present invention, however, reduces or prevents such print quality defects and, in addition, allows the average printer to operate just below the maximum theoretical print speed. The present invention includes an encoder pending circuit 62 operating in conjunction with the printhead driver circuitry, including the printhead controller/state machine 21, to store encoder pulses occurring while the printhead is depositing ink in the current stroke or the current printing operation. Immediately after completion of the current stroke, the next stroke or pending stroke or new printing operation will be started. If during this stroke, another pulse is encountered, the process of storing the early encoder pulse is repeated.

Figure 3:
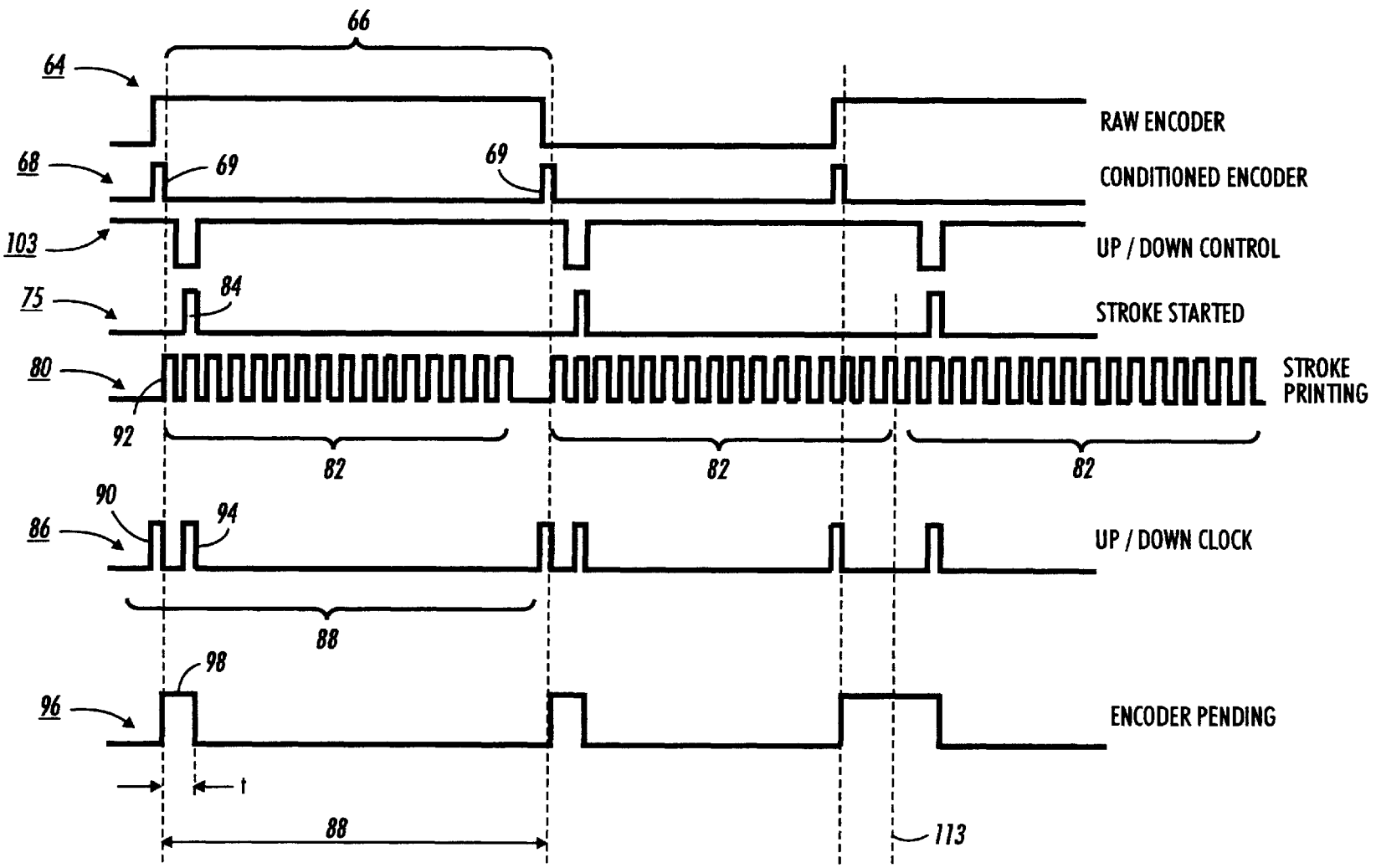
FIG. 3 is a signal diagram illustrating the generated timing signals of the present invention.

FIG. 3 illustrates a timing diagram for the present invention. A raw encoder pulse waveform 64 includes a series of positive going square waves, one of which is illustrated as a normal cycle 66. The raw encoder pulse, which is generated by the sensor 50 scanning past the encoder strip 46, is then conditioned by known circuitry such that a conditioned encoder pulse waveform 68 is generated. For each edge of the raw encoder pulse waveform which either rises or falls, a short duration pulse 69 is generated. This conditioned encoder pulse waveform is input to an OR gate 70 of the encoder pending circuitry 62 over a signal line 72 as illustrated in FIG. 2. A second input line 74 of the OR gate 70 receives a stroke started signal 75 generated by the printhead controller/state machine 21 over the line 74 indicating that the printhead has begun or is printing a stroke. This stroke started signal is ORed with the conditioned encoder signal and input to a clock input 76 of an up/down counter 78.

Referring back to FIG. 3, the stroke started signal 75 is generated by the printhead controller/state machine 21 in response to a stroke printing wave form 80, which for purposes of illustration includes a series of pulse sequences 82 each including sixteen pulses for illustration. Each pulse causes the printhead 20 to eject ink simultaneously from any nozzle in one of the banks of the linear array of nozzles. As an example, for a printhead having 128 nozzles with 32 banks of nozzles, each having four nozzles per bank, the number of individual pulses within the pulse sequence 82 would be thirty-two.

The stroke started signal 75, generated in response to the stroke printing signal 82, includes a single pulse 84 one for each pulse sequences 82 which is being generated at the second pulse of each pulse sequence 82 to avoid any race conditions which might occur. It is this stroke started signal 75 and the conditioned encoder signal 68 which are ORed together at the OR gate 70.

Since the output of the OR gate 70 is either the conditioned encoder signal 68 or the stroke started signal 75, an up/down clock waveform 86, the output of the OR gate 70, includes two pulses over a stroke printing period 88 marked by the dotted lines. As can be seen in FIG. 3, for a first portion 88 of the up/down clock signal 86, a first pulse 90 immediately precedes a first pulse 92 of one of the series of stroke printing signals 82 and a second pulse 94 of the up/down clock signal 86 is generated during the section of a stroke printing signal 82. These two pulses 90 and 94 are generated as illustrated when the encoder pulse of the conditioned encoder 68 is properly generated after a printing stroke of the printhead has been completed. The up/down clock signal 86 is used to generate an encoder pending signal 96 which includes a number of pulses, each of which is generated in response to a single conditioned encoder pulse and an associated single stroke started pulse, such that the time period T of an encoder latch pulse 98 corresponds approximately to the time between the generation of the conditioned encoder pulse and the stroke started pulse.

The encoder pending signal 96 is used to determine if an encoder pulse is early. Referring to FIG. 2, the signal 96 is transmitted over an output line 100 to the printhead controller/state machine 21 from an OR gate 102 coupled to the Q outputs of the counter 78. The encoder latched signal 96 is generated in response to the up/down clock signal 86 and a up/down control signal 103 generated by the controller/state machine 21 which is input to the up/down input of the up/down counter 78. The up/down control signal 103 is a signal transitioning from a high to a low value when a stroke or printing operation begins. The high value or state of the up/down count signal 99 on a line 104 causes the counter 78 to count up. When the signal on the line 104 is high and an encoder pulse is transmitted through the OR gate 70, the up/down counter 78 increases by one such that the output of a line Q0 which is input to the OR gate 102 generates the encoder latch signal on line 100. The up/down control signal 103, when low, causes the counter 78 to count down such that when an encoder pulse is received after the completion of a printing swath, the counter 78 counts down setting $Q_0$ to zero.

Figure 4:
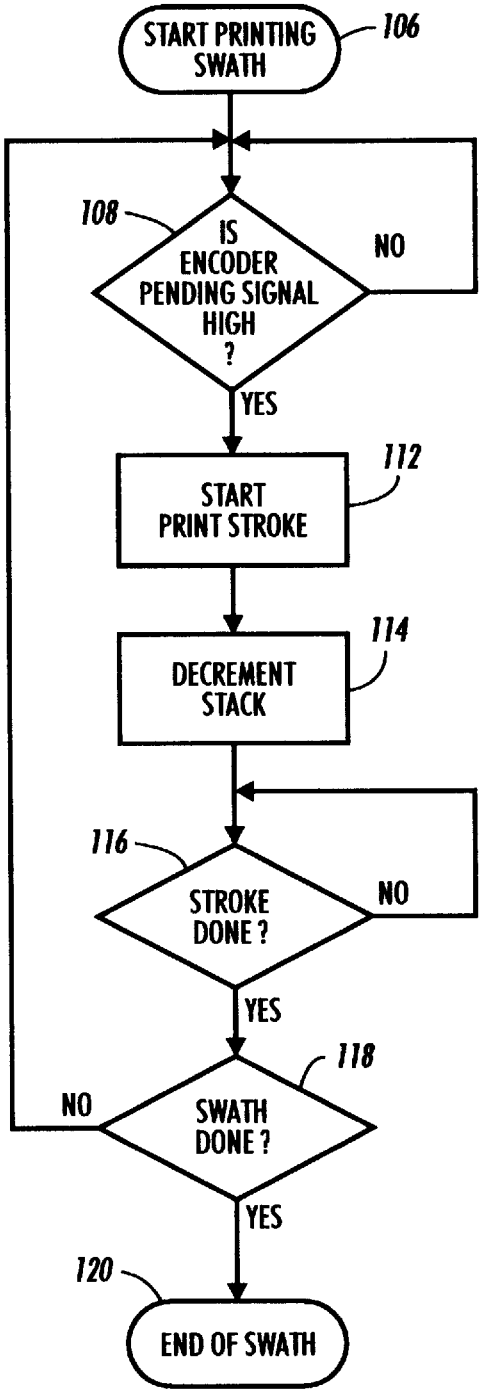
FIG. 4 is a flow diagram illustrating a method for generating pending an encoder pulse and completing a printing operation in response thereto.

The encoder pending signal 96 is monitored or interrogated by the controller/state machine 21 as illustrated in the flow chart of FIG. 4. Assuming that an encoder pulse is properly generated before the printing of a swath, then at step 106, a new printing swath is started. The controller/state machine 21 monitors the state of the encoder pending signal 96 at the end of the pulse sequence 82 to determine if a conditioned encoder signal has been generated while the printhead is still printing. If this interrogation determines that the encoder pending signal is low, at a step 108, then the controller/state machine 21 does not transmit an enable signal over the enable line 110 to the printhead 20 to being printing a stroke. If, however, the encoder pending signal is high as determined at step 108, then the controller/state machine generates an enable signal enabling the printhead 20 to start a print stroke or new printing operation at step 112. This state is illustrated in FIG. 3 at location 113 of the encoder pending signal. Once the print stroke has been started, then at step 114, the stack of the counter 78 is decrimented. A determination is then made as to whether or not the printhead has completed printing the current stroke at step 116. If the stroke is not complete, then the controller/state machine 21 continues to monitor the status of the printhead until it is determined that the stroke is complete. Once complete, it is determined at step 118 whether or not a swath has been completed. If a swath has not been completed, then the state machine 21 returns to step 108 to determine the state of the encoder latch signal. The process is continually repeated until the end of a swath is determined at step 120.

By including the encoder pending circuit 62 in a printing apparatus, printer operation can be maintained at just below the maximum theoretical print speed without major print quality defects. It has been found that motion speed variations of the motor 44 driving the scanning printhead, typically exceed a nominal speed as a low frequency variation of motion around nominal in approximately the 10–15% range. Because overspeed is a condition which occurs sporadically, it has been found that a simple flip flop or a counter of one deep is typically all that is necessary for generating the encoder pending signal since the problem of the early encoder pulse typically does not occur on a subsequent printing stroke of a printhead. It is possible, however, to use the multiple bit counter 78 as well as additional counters or stacks 122 to detect larger overflows which would indicate that multiple short duration encoder pulses exist. Outputs of the counter Q0 through Q3 could be monitored by a second state machine or controller 124, or the first controller/state machine 21, to determine whether fast scan motion quality problems exist. The state machine 124 could generate a signal indicating a motion quality problem exists for notifying the user through an indicator such as a light. For instance, slipping belts or improperly positioned encoder strips could generate multiple encoder latched signals during printing indicating the existence of problems resulting from other than simple motion speed variations.

In recapitulation, there has been described an apparatus and method for printing documents with a printing apparatus having encoder pending. Encoder pending allows a printer to operate just below the maximum theoretical print speed without major print quality defects by pending early encoder pulses until the printing element or printhead has completed the present jetting stroke. It is, therefore, apparent that there has been provided in accordance with the present invention, an encoder pending system for a printer that fully satisfies the aims and advantages hereinbefore set forth. While this invention has been described in conjunction with a specific embodiment thereof, it is evident that many alternatives, modifications, and variations will be apparent to those skilled in the art. The present invention is not limited to printers, however, but is equally applicable to any machine having a moving member under control of an encoder or similar system. Accordingly, it is intended to embrace all such alternatives, modifications and variations that fall within the spirit and broad scope of the appended claims.

What is claimed is:

1. A printing apparatus printing on a recording medium in response to encoder pulses of an encoder signal generated by an encoder, comprising:

an encoder pending circuit, coupled to the encoder, receiving the encoder pulses therefrom, outputting an encoder pending signal indicating the generation of one of the encoder pulses during a current printing operation; and a controller, coupled to said encoder pending circuit, receiving the encoder pending signal, completing the current printing operation in response to the received encoder pending signal, and generating an enable signal after the completion of the current printing operation to start a new printing operation immediately thereafter.

2. The printing apparatus of claim 1, wherein said encoder pending circuit includes a state indicator circuit storing an indicator indicating a generation of one of the encoder pulses during the current printing operation.

3. The printing apparatus of claim 2, wherein said state indicator circuit comprises an up/down counter including a clock input and an up/down count input.

4. The printing apparatus of claim 3, wherein said controller generates a printing started signal for transmission to said encoder pending circuit.

5. The printing apparatus of claim 4, wherein said controller generates an up/down count control signal including a state indicating the printing apparatus being in a current printing operation.

6. The printing apparatus of claim 5, wherein said controller generates the enable signal after examining the state of the encoder pending signal.

7. The printing apparatus of claim 1, comprising a printhead including a plurality of ink ejecting nozzles ejecting ink substantially simultaneously during a printing stroke.

8. The printing apparatus of claim 7, wherein said plurality of ink ejecting orifices comprises a plurality of banks of nozzles, said nozzles within one of said banks ejecting ink substantially simultaneously and said plurality of banks of nozzles ejecting ink sequentially to complete the printing stroke.

9. The printing apparatus of claim 8, wherein said encoder pending circuit includes a state indicator circuit storing an indicator indicating a generation of one of the encoder pulses being generated during the current printing operation.

10. The printing apparatus of claim 9, wherein said state indicator circuit comprises an up/down counter including a clock input and an up/down count input.

11. The printing apparatus of claim 10, wherein said controller generates a printing started signal for transmission to said encoder pending circuit.

12. The printing apparatus of claim 11, wherein said controller generates an up/down count control signal including a state indicating the printhead is currently ejecting ink.

13. The printing apparatus of claim 12, wherein said controller generates the enable signal after examining the state of the encoder pending signal.

14. A method of controlling a printing element of a printing apparatus printing on a recording medium in response to encoder pulses of an encoder signal generated by an encoder, comprising:

receiving one of the encoder pulses;

determining whether the received encoder pulse is generated during a current printing operation of the printing element;

completing the current printing operation before responding to the received one of the encoder pulses; and beginning a new printing operation immediately after said completing step if said determining step determines the received encoder pulse is generated during the current printing operation.

15. The method of claim 14, wherein said determining step comprises determining whether the received encoder pulse is generated during a current printing operation of the printing element by examining an encoder pending signal indicating that the received encoder pulse is generated during a current printing operation.

16. The method of claim 15, further comprising generating an encoder pending signal in response to the received one of the encoder pulses.

17. The method of claim 16, wherein said generating step comprises generating an encoder pending signal in response to the received one of the encoder pulses and a printing signal indicating the print element is in the current printing operation.

18. The method of claim 17, wherein said generating step comprises generating the encoder pending signal with an up/down counter.

19. The method of claim 18, wherein said generating step comprises generating the encoder pending signal with an up/down counter including an up/down counter input receiving the printing signal.

20. The method of claim 19, wherein said method includes controlling a printing element including an ink jet printhead including a plurality of banks of nozzles, the banks of nozzles depositing ink sequentially and the nozzles within a bank ejecting ink substantially simultaneously.

* * * * *